US008960820B2

(12) United States Patent
Chen

(10) Patent No.: US 8,960,820 B2
(45) Date of Patent: Feb. 24, 2015

(54) GUIDED SLIDE ASSEMBLY

(71) Applicant: Slide Mei Yao International Co., Ltd., New Taipei (TW)

(72) Inventor: Tsung-Yao Chen, Chiayi County (TW)

(73) Assignee: Slide Mei Yao International Co., Ltd., New Taipei (TW)

( * ) Notice: Subject to any disclaimer, the term of this patent is extended or adjusted under 35 U.S.C. 154(b) by 0 days.

(21) Appl. No.: 13/675,125

(22) Filed: Nov. 13, 2012

(65) Prior Publication Data

US 2013/0129267 A1 May 23, 2013

(30) Foreign Application Priority Data

Nov. 18, 2011 (TW) ..... 100142291

(51) Int. Cl.

*A47B 95/02* (2006.01)
*A47B 88/00* (2006.01)
*A47B 88/04* (2006.01)

(52) U.S. Cl.

CPC ..... *A47B 88/04* (2013.01); *A47B 2210/0078* (2013.01)
USPC ..... 312/331

(58) Field of Classification Search

CPC ..... A47B 88/08; A47B 88/10; A47B 88/12; A47B 2210/0059; A47B 2210/0032; A47B 2210/0064; A47B 2210/0067; A47B 2210/007; A47B 2210/0078; A47B 2210/0083; A47B 2210/17; A47B 2210/175; A47B 2210/0013
USPC ..... 312/331, 334.7, 334.8, 402, 404
See application file for complete search history.

(56) References Cited

U.S. PATENT DOCUMENTS

| | | | | |
|---|---|---|---|---|
| 1,806,174 | A * | 5/1931 | Morin | 312/331 |
| 3,093,429 | A * | 6/1963 | Curtis et al. | 312/331 |
| 3,241,283 | A | 3/1966 | Ahlgreen | |
| 4,324,439 | A * | 4/1982 | Hagen et al. | 384/18 |
| 4,662,531 | A * | 5/1987 | Ramspacher et al. | 220/4.21 |
| 5,388,370 | A | 2/1995 | Tonsmann | |
| 6,494,550 | B1 * | 12/2002 | Chen et al. | 312/334.5 |
| 7,077,488 | B2 * | 7/2006 | Wiklund et al. | 312/333 |
| 7,384,108 | B2 * | 6/2008 | Lam et al. | 312/334.44 |
| 2009/0026903 | A1 * | 1/2009 | Laible | 312/334.8 |
| 2010/0123378 | A1 * | 5/2010 | Chen et al. | 312/333 |
| 2010/0283365 | A1 * | 11/2010 | Chen | 312/334.4 |
| 2011/0012492 | A1 * | 1/2011 | Radusin | 312/334.8 |
| 2011/0037362 | A1 * | 2/2011 | Park et al. | 312/319.1 |
| 2011/0187254 | A1 * | 8/2011 | Chen et al. | 312/334.8 |
| 2012/0091872 | A1 * | 4/2012 | Matthes et al. | 312/334.8 |
| 2012/0306337 | A1 * | 12/2012 | Hammerle | 312/334.8 |
| 2013/0129266 | A1 * | 5/2013 | Chen | 384/20 |
| 2013/0249367 | A1 * | 9/2013 | Chen | 312/334.8 |

FOREIGN PATENT DOCUMENTS

| | | | | |
|---|---|---|---|---|
| EP | 0848922 | A2 | 6/1998 | |
| EP | 1913842 | A1 * | 4/2008 | A47B 88/14 |

(Continued)

*Primary Examiner* — Janet M Wilkens
*Assistant Examiner* — Andrew Roersma
(74) *Attorney, Agent, or Firm* — Rosenberg, Klein & Lee

(57) ABSTRACT

A guided slide assembly includes at least one sliding rail unit having a longitudinal base plate, a pair of guide plates extending respectively and transversely from two opposite sides of the base plate, and at least one securing portion formed on one of the guide plates. At least one longitudinal guiding unit is detachably disposed on the one of the guide plates, and has a longitudinal rack member and at least one engaging hook disposed on the rack member. The engaging hook engages the securing portion of one on the guide plates.

6 Claims, 7 Drawing Sheets

(56) References Cited

FOREIGN PATENT DOCUMENTS

| | | | | | |
|---|---|---|---|---|---|
| EP | 2186437 | A2 * | 5/2010 | ..... | A47B 88/12 |
| EP | 2206869 | A1 | 7/2010 | | |
| GB | 2030847 | A * | 4/1980 | ..... | A47B 88/04 |
| WO | WO2011003740 | A1 * | 1/2011 | ..... | A47B 88/04 |
| WO | WO2011094788 | A1 * | 8/2011 | ..... | A47B 88/04 |

* cited by examiner

GUIDED SLIDE ASSEMBLY

CROSS-REFERENCE TO RELATED APPLICATION

This application claims priority of Taiwanese patent application no. 100142291, filed on Nov. 18, 2011.

BACKGROUND OF THE INVENTION

1. Field of the Invention

The invention relates to a guided slide assembly, more particularly to a guided slide assembly that involves synchronous push-pull operation.

2. Description of the Invention

A common guided slide device, such as those used with a drawer, includes two outer slide rails that are respectively secured to two opposite inner surfaces of two side walls of a cabinet, two inner slide rails that are respectively and movably disposed in the outer slide rails and that are respectively secured to two opposite sides of a drawer, and a plurality of balls that are disposed between the inner and outer slide rails. Each outer slide rail has a base plate that is secured to the inner surface of the corresponding side wall of the cabinet and two guide plates that respectively and transversely extend from two opposite sides of the base plate. The guide plates of each outer slide rail are respectively disposed above and below the corresponding one of the inner slide rails. The balls are disposed between the guide plates and the corresponding inner slide rail.

Because the two pairs of outer and inner slide rails are disjoint, the inner slide rails generally are not able to synchronously move relative to the outer slide rails. When opening or closing the drawer, the drawer tends to swerve, loosen, and make noise.

To improve the aforesaid problems, an engagement structure of pinion gears and racks has been applied to the conventional guided slide device to synchronize movement of the inner slide rails relative to the outer slide rails and to prevent the drawer from swerving.

For example, a rack and one of the guide plates of the outer slide rails are integrally formed in one piece. However, such integral configuration may not provide smooth contact between the balls and an inner surface of the corresponding guide plate, thereby causing unsmooth rotation of the balls between the inner and outer slide rails. To avoid unsmooth rotation of the balls, the racks are respectively fixed on the base plates of the outer slide rails. This modification, however, causes the base plates to be unable to be fittedly and directly secured to the corresponding inner surfaces of the cabinet. Thus, to accommodate the conventional guided slide assembly, assembly procedures and the dimensions of the drawer may need to be modified, thereby increasing the assembly cost and limiting application of the guided slide assembly.

SUMMARY OF THE INVENTION

Therefore, the present invention aims to provide a guided slide assembly that can alleviate at least one drawback of the conventional guided slide device.

According to one aspect of the present invention, a guided slide assembly includes: at least one sliding rail unit having a longitudinal base plate, a pair of guide plates extending respectively and transversely from two opposite sides of the base plate, and at least one securing portion formed on one of the guide plates; and at least one longitudinal guiding unit that is detachably disposed on the one of the guide plates. The longitudinal guiding unit has a longitudinal rack member and at least one engaging hook disposed on the rack member. The engaging hook engages the securing portion on the one of the guide plates.

According to another aspect of the present invention, a guiding unit of a guided slide assembly includes a longitudinal rack member formed with a longitudinal toothed portion, and at least one engaging hook formed on the rack member.

According to yet another aspect of the present invention, a sliding rail unit of a guided slide assembly includes a first slide rail having a longitudinal base plate and a pair of guide plates extending respectively and transversely from two opposite sides of the base plate, at least one securing portion formed on one of the guide plates, and a second slide rail slidable relative to the first slide rail.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
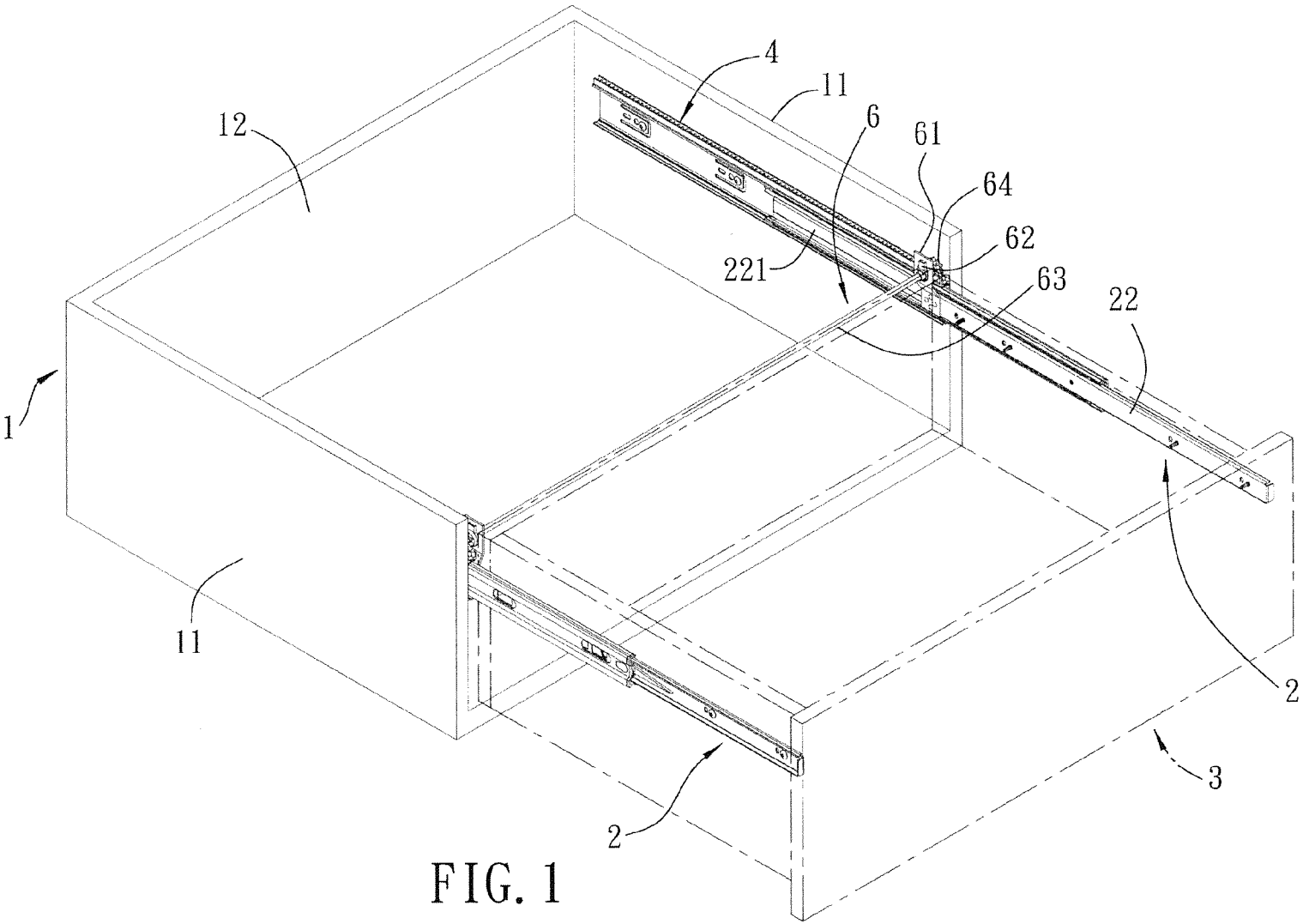
FIG. 1 is a perspective view illustrating how the preferred embodiment of a guided slide assembly according to the present invention is assembled with a cabinet having a drawer.
Figure 2:
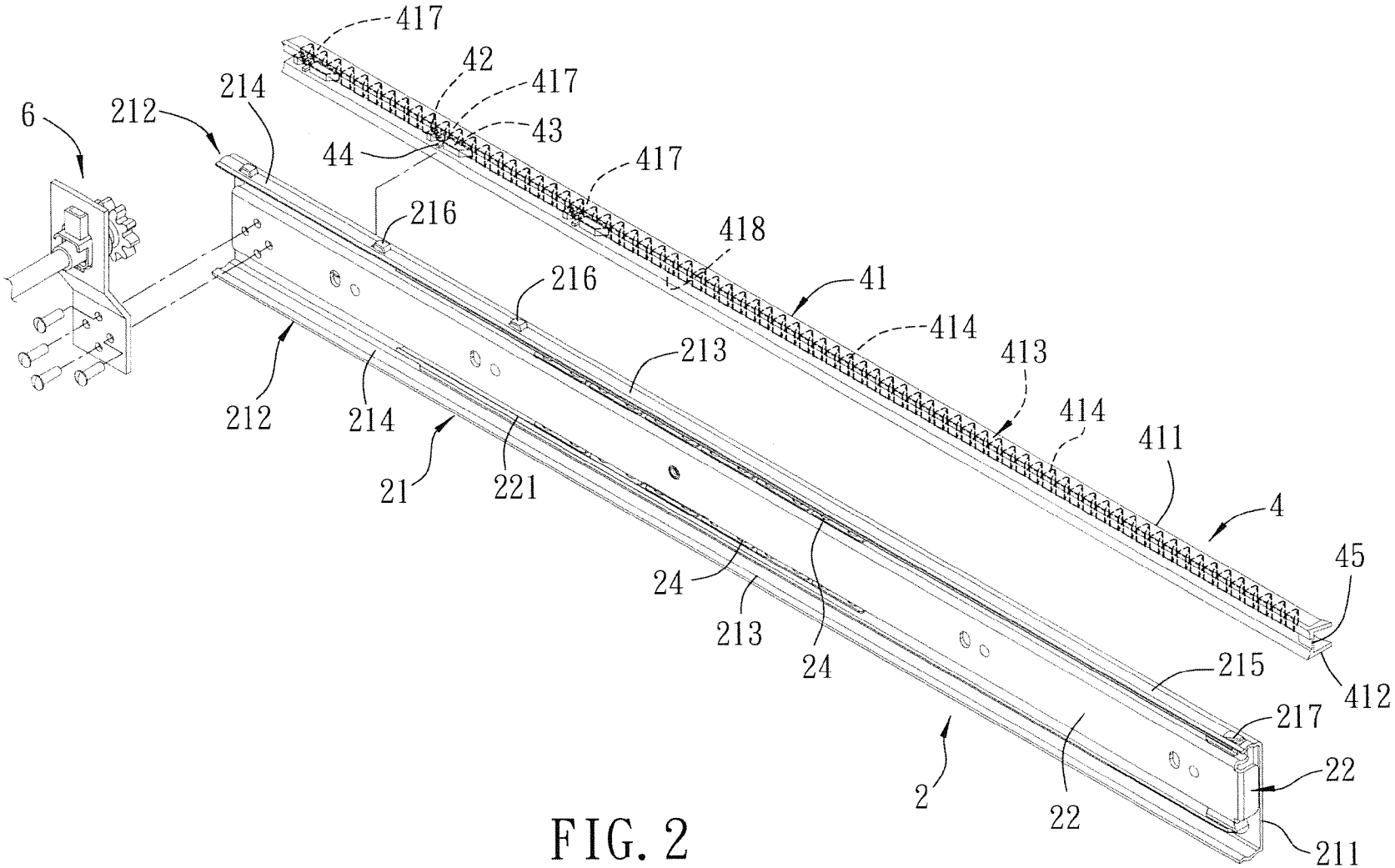
FIG. 2 is an exploded, fragmentary perspective view illustrating cooperation among a linking unit, a sliding rail unit, and a guiding unit of the preferred embodiment.

FIG. 1 illustrates a cabinet body 1 assembled with the preferred embodiment of a guided slide assembly of the present invention. The cabinet body 1 defines a receiving space 12 and includes two opposite longitudinal side walls 11 and a drawer 3. The guided slide assembly includes two sliding rail units 2 and two longitudinal guiding units 4 that are respectively and detachably disposed on the sliding rail units 2. Each of the sliding rail units 2 is respectively disposed on a corresponding one of the longitudinal side walls 11 of the cabinet body 11 and engaged with the drawer 2. The two sliding rail units 2 are linked by a linking unit 6 so that the two sliding rail units 2, the drawer 2, and the linking unit 6 are operated in a synchronous push-and-pull manner. Since the two incorporated structures respectively formed by the two sliding rail units 2 and the two longitudinal side walls 11 of the cabinet body 1 are symmetrically identical, only one of the incorporated structures is illustrated hereinafter.

Referring to FIGS. 1 to 5, each sliding rail unit 2 has a first slide rail 21 that has a longitudinal base plate 211 secured on the corresponding side wall 11 of the cabinet body 1, a pair of guide plates 212 that extend respectively and transversely from two opposite sides of the base plate 211, and a second slide rail 22 that is slidable relative to the first slide rail 21 and that has an inner surface connected to a side of the drawer 3.

Each of the guide plates 212 has a non-roller-free section 213, and a first roller-free section 214 and a second roller-free section 215 respectively and longitudinally extending from two opposite ends of the non-roller-free section 213.

The sliding rail unit 2 further includes a third slide rail 221 that is slidably disposed between the pair of guide plates 212 of the first slide rail 21 and that is slidable together with the second slide rail 22 relative to the first slide rail 21.

Referring to FIGS. 2 to 5, the longitudinal guiding unit 4 is detachably disposed on one of the guide plates 212 and includes a longitudinal rack member 41 and three engaging hooks 42 disposed on the rack member 41.

Figure 7:
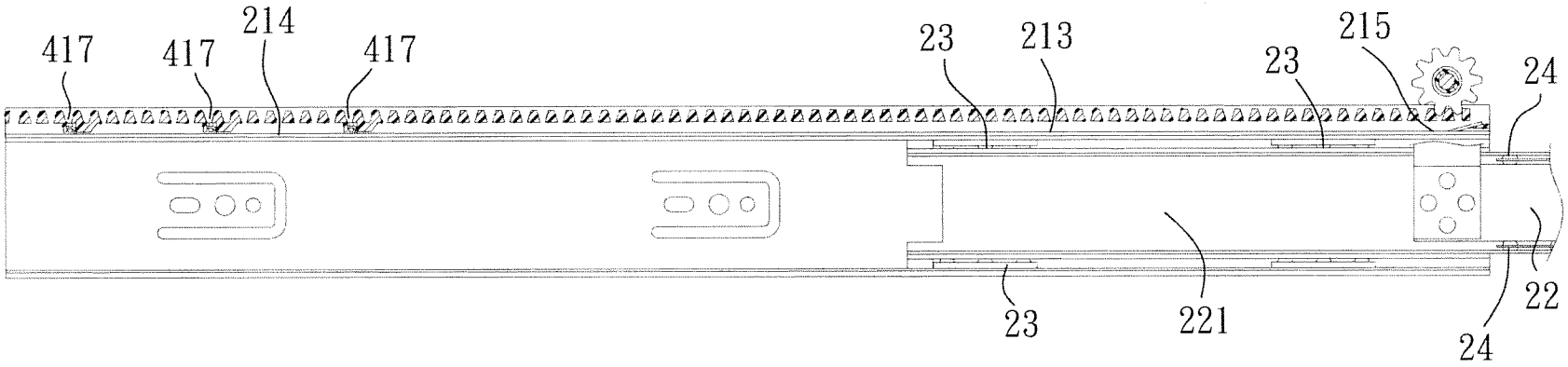
FIG. 7 is a fragmentary, partly sectional view illustrating a fully extended state of the preferred embodiment.

Referring to FIG. 7 in combination with FIGS. 2 to 5, the sliding rail unit 2 further includes at least one securing portion 216 formed on the guide plate 212 that is detachably disposed with the longitudinal guiding unit 4. In this embodiment, three spaced-apart securing portions 216 are configured as slit hooks and are longitudinally formed by a pressing process on the first roller-free section 214 of the guide plate 212 that is detachably disposed with the longitudinal guiding unit 4. However, the present invention is not limited in this respect, and the number of securing portions 216 may be adjusted accordingly.

Preferably, the first slide rail 21 further has an inclined tab 217 formed on the second non-roller-free section 215 of the guide plate 212 that is detachably disposed with the longitudinal guiding unit 4 and inclined forwardly and upwardly relative to the same.

Figure 5:
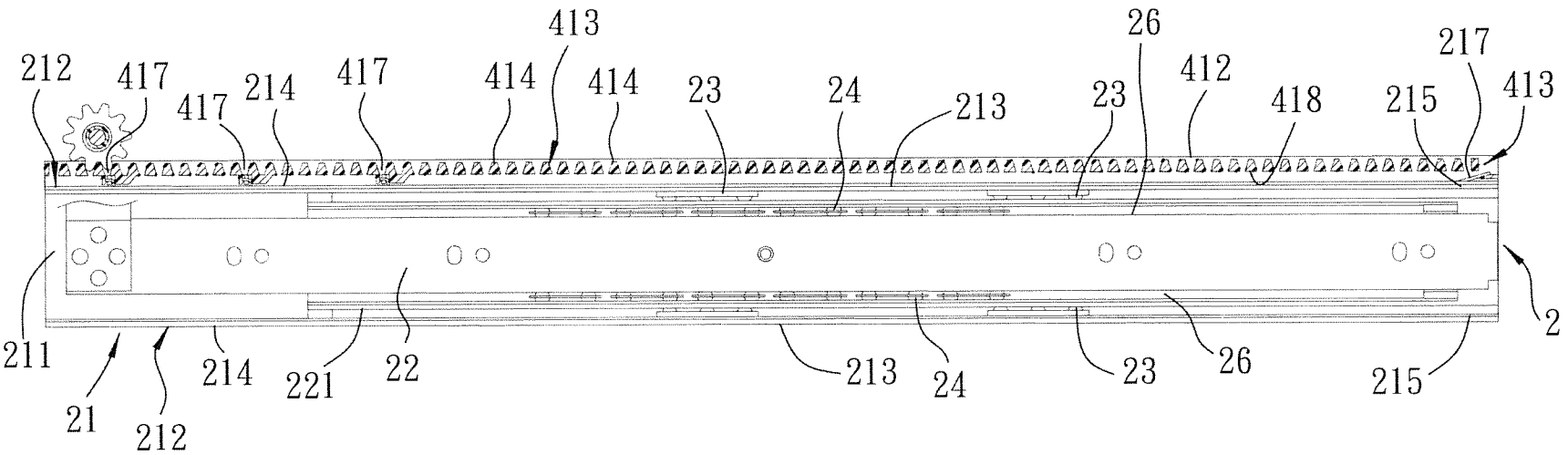
FIG. 5 is a partly sectional view illustrating a fully retracted state of the preferred embodiment.

As shown in FIGS. 5 and 7, a plurality of first sets of balls 23 that are configured in rows are rollably disposed between the non-free-roller section 213 of the first slide rail 21 and the third slide rail 221 at upper and lower sides of the third slide rail 221. Further, a plurality of second sets of balls 24 that are configured in rows are rollably disposed between the third slide rail 221 and the second slide rail 22 at upper and lower sides of the second slide rail 22. When the guided slide assembly is in a completely retracted state (see FIG. 5) or in a completely extended state (see FIG. 7), the first sets of balls 23 are unable to roll into the first roller-free sections 214 or the second roller-free sections 215 of the guide plates 212.

Although the sliding rail unit 2 in this embodiment is shown as a three-stage slide rail mechanism including the first, second, and third slide rails 21, 22, 221 and the first and second sets of the balls 23, 24, a two-stage slide rail mechanism may also be employed, that is the third slide rail 221 and the second sets of balls 24 may be omitted in other embodiments of the invention.

Referring back to FIGS. 2 to 5, the guiding unit 4 includes the longitudinal rack member 41 that is formed with a longitudinal toothed portion 413 and the engaging hooks 42 that are formed on the rack member 41. In this embodiment, the longitudinal toothed portion 413 is formed on one side of the longitudinal rack member 41, and the engaging hooks 42 are formed on another side of the rack member 41 opposite to the toothed portion 413. The longitudinal toothed portion 413 is detachably disposed on the one of the guide plates 212. The rack member 41 further includes two spaced-apart longitudinal retaining walls 411, 412 respectively disposed on the one of the guide plates 212 that is detachably disposed with the longitudinal guiding unit 4. The toothed portion 413 bridges the two retaining walls 411, 412. Although, in this embodiment, the retaining walls 411, 412 are used for securely fixing the guiding unit 4 on the corresponding one of the guide plates 212, the retaining walls 411, 412 are not strictly necessary as long as the guiding unit 4 can be securely fixed to the corresponding one of the guide plates 212, for example, by molding the rack member 41 and the toothed portion 413 together as a single piece of plastic material.

The toothed portion 413 has a plurality of teeth 414, a plurality of apertures 417 each formed between two adjacent teeth 414, three abutment members 43 opposite to the teeth 414, and three pairs of side retaining elements 44 projecting from a back side 418 of the toothed portion 413 opposite of the teeth 414. In this case, the retaining elements 44 respectively extend on two opposite sides of the engaging hooks 42. Preferably, the rack member 41 further has a longitudinal recess 419 that is confined by the retaining walls 411, 412 and the back side 418 of the toothed portion 413. The longitudinal recess 419 accommodates the three abutment members 43, the three pairs of side retaining elements 44, and the three engaging hooks 42.

Figure 3:
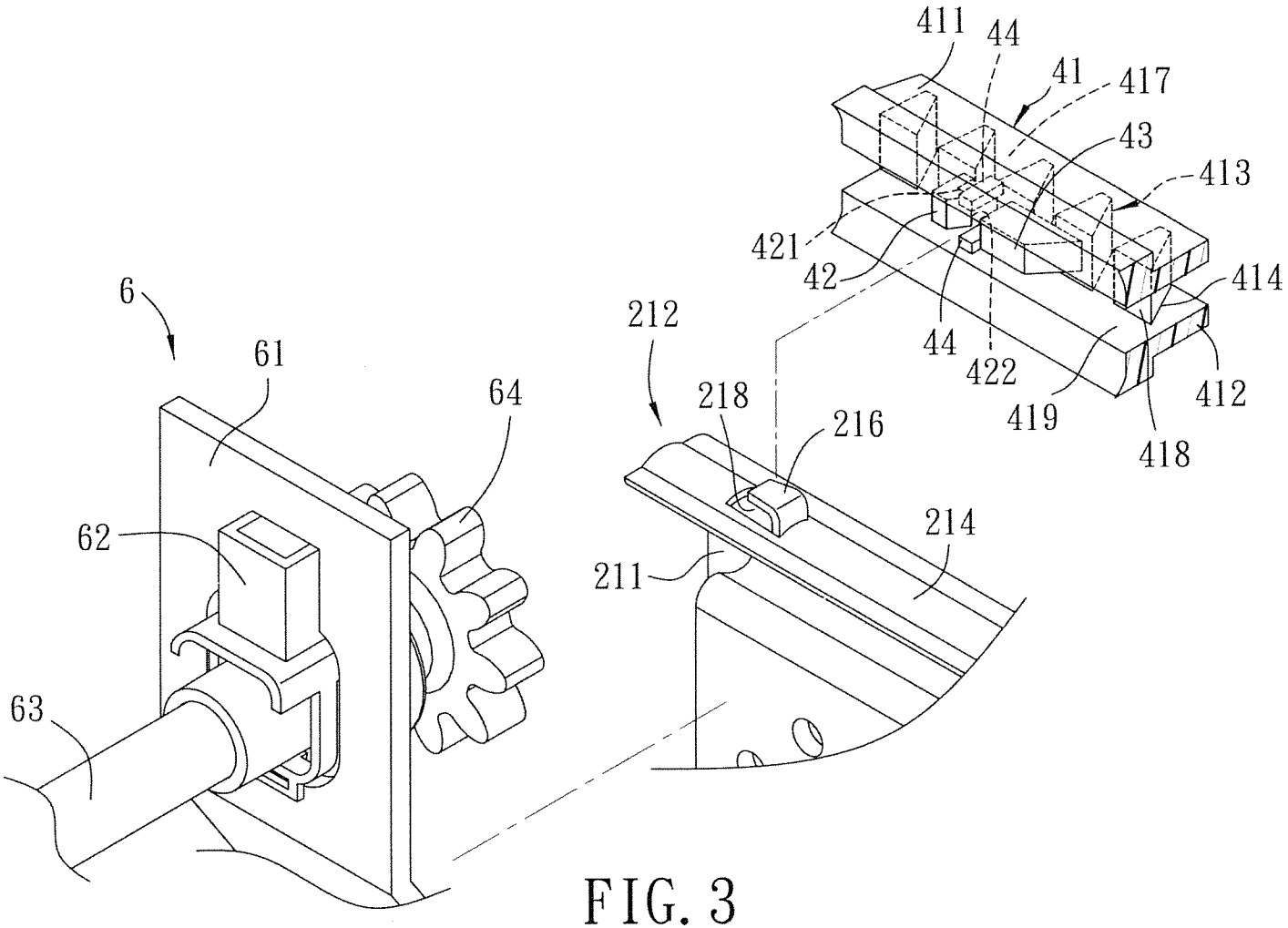
FIG. 3 is a partly enlarged, fragmentary perspective view of the preferred embodiment shown in FIG. 2.
Figure 4:
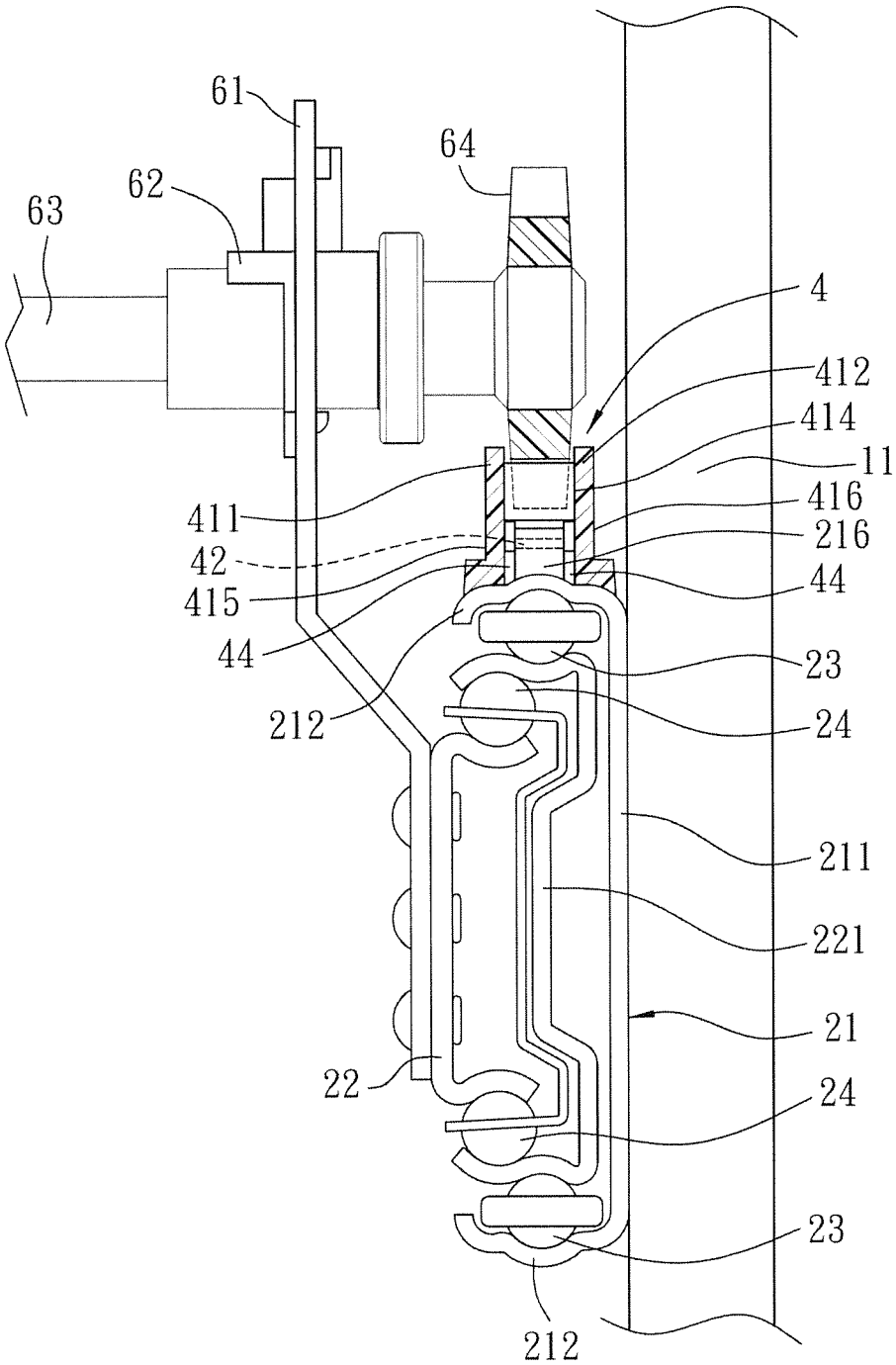
FIG. 4 is a fragmentary, partly sectional, schematic view illustrating assembly of the linking unit, the sliding rail unit, and the guiding unit of the preferred embodiment.
Figure 6:
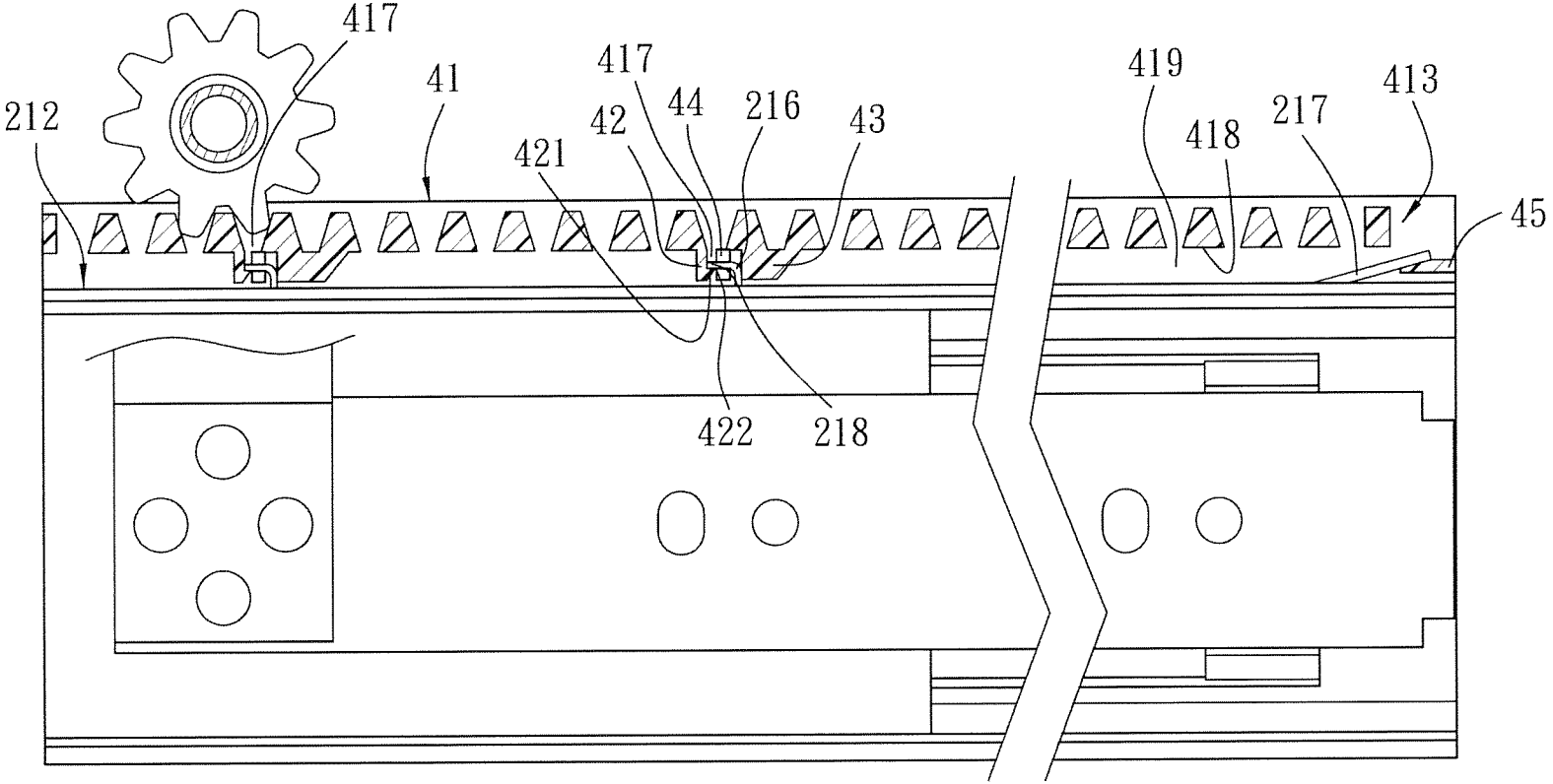
FIG. 6 is an enlarged, fragmentary view illustrating a portion of the preferred embodiment shown in FIG. 5.

Referring to FIGS. 3, 4, and 6, the three engaging hooks 42 are spaced-apart from each other and each projects from the back side 418 of the toothed portion 413 opposite of the teeth 414 for engaging the corresponding securing portion 216 of the guide plates 212. Alternatively, the engaging hooks 42 may respectively extend from two opposite side surfaces of the rack member 41. In this embodiment, each engaging hook 42 has a barb surface 421 adjacent to the apertures 417 of the toothed portion 413. Alternatively, each aperture 417 is formed between two adjacent teeth 414 and may extend from the barb surface 421 through the toothed portion 413. In this embodiment, when the guiding unit 4 is assembled with the rail unit 2, each engaging hook 42 has an open end 422 facing toward the inclined tab 217. Each securing portion 216 has an open end 218 facing the open end 422 of the corresponding engaging hook 42 so that the engaging hook 42 can engage the securing portion 216. Alternatively, the open end 422 of the engaging hook 42 may face away from the inclined tab 217 and the open end 218 of the securing portion 216 may still face toward the open end 422 of the corresponding engaging hook 42 such that the engaging hook 42 and the securing portion 216 may engage each other. It should be noted that the number of the engaging hooks 42 is equal to that of the securing portions 216.

Each abutting member 43 is spaced apart from the engaging hook 42 and aligned with the open end 422 of the engaging hook 42. When the guiding unit 4 is assembled with the rail unit 2, the abutting member 43 abuts against the corresponding securing portion 216. No matter what the configurations of the open end 422 of the corresponding engaging hook 42 and the open end 218 of the corresponding securing portion 216 are, the corresponding abutting member 43 is aligned with the open end 422 of the corresponding engaging hook 42 and abuts against the corresponding securing portion 216.

When the guiding unit 4 is assembled with the rail unit 2, each pair of retaining elements 44 respectively abut against the two opposite sides of the corresponding securing portion 216 for preventing movement between the guiding unit 4 and the rail unit 2. In this embodiment, each securing portion 216 is a slit hook. Alternatively, each securing portion 216 maybe configured as a securing hole for engaging and positioning the engaging hook 42 so that the retaining members 44 may be omitted.

Preferably, the guiding unit 4 further includes a slotted part 45 disposed at one end of the rack member 41 for engaging the inclined tab 217.

Moreover, by virtue of the synchronous push-and-pull mechanism of the sliding rail units 2, the drawer 2 and the linking unit 6, the drawer 3 can smoothly move into the receiving space 12 of the cabinet body 1 when the guided slide assembly is in a fully retracted state, and can smoothly move out of the receiving space 12 of the cabinet body 1 when the guided slide assembly is in a fully extended state. As shown in FIGS. 1, 3, and 4, the linking unit 6 includes two connecting plates 61, two supporting seats 62 respectively disposed on the connecting plates 61, two pinion gears 64 respectively and rotatably disposed on the supporting seats 62, and a rotating shaft 63 having two sides for journaling the pinion gears 64, respectively. The connecting plates 61 are respectively riveted to the rear portions of the second slide rails 22, and the upward extending portions of the connecting plates 61 partially project away from the respective first slide rails 21. The pinion gears 64 respectively mesh with the rack members 41 of the guiding unit 4.

When the drawer 3 is pulled out the cabinet body 1, the second slide rail 22 and the third slide rail 221 are driven to move together with the linking units 6 so that the pinion gears 64 respectively move along the guiding units 4. Since the pinion gears 64 have the same number of revolutions when rotating, the second slide rails 22 are synchronized in motion. In addition, each securing portion 216 is formed by a pressing process on the first roller-free section 214 of the guide plate 212 and the inclined tab 217 is formed by a pressing process on the second roller-free section 215 of the guide plate 212. Therefore, the formation of the securing portions 216 and the inclined tab 217 does not affect the smoothness of the non-roller-free section 213 of the guide plate 212 so that the first sets of balls 23 can smoothly roll against the non-roller-free section 213. Thus, the drawer 3 can be stably pulled out from and smoothly pushed back into the cabinet body 1.

During an assembling process, the sliding rail units 2, the connecting plates 61, and the supporting seats 62 must be assembled prior to shipment from a factory. Subsequently, the rotating shaft 63, the guiding unit 4, and the pinion gears 64 may be assembled on site. When assembling on site, the base plate 211 of the corresponding slide rail unit 2 is fittedly secured to the corresponding side walls 11 of the cabinet body 1. Afterwards, the guiding unit 4 is engaged to the top of the guide plate 212 of the corresponding one of the first slide rails 21. The pinion gears 64, the rotating shaft 63, and the supporting seats 62 are assembled with each other. Next, the pinion gear 64 is ensured to be properly meshed with the guiding unit 4. Finally, the second slide rail 22 is secured to the corresponding side of the drawer 3 to complete assembly of the cabinet body 1, the guided slide assembly, and the drawer 3.

Specifically, when the guiding unit 4 is disposed on top of the first slide rail 21, the slotted part 45 of the guiding unit 4 is first engaged with the inclined tab 217 of the first slide rail 21. The engaging hooks 42 of the guiding unit 4 are respectively and clinchingly engaged to the securing portions 216 of the first slide rails 21. As shown in FIG. 6, the barb surface 421 of the corresponding engaging hook 42 engagingly hooks onto the corresponding securing portion 216. Simultaneously, the corresponding abutting member 43 and the pair of corresponding retaining elements 44 ensure tight and secure engagement between the corresponding engaging hook 42 and the corresponding securing portion 216. Therefore, the guiding unit 4 is simply and expeditiously disposed on the corresponding slide rail unit 2. In actual implementation, a width between the retaining walls 411, 412 can be narrowed for positioning the engaging hook 42 in the corresponding securing portion 216.

By virtue of the engagement structure of the present invention, the securing portions 216 and the inclined tab 217 formed on the corresponding guide plate 212 of the first slide rail 21 can quickly and respectively engage the engaging hooks 42 and the slotted part 45 of the corresponding guiding unit 4. Therefore, the corresponding guiding unit 4 is easily assembled with the corresponding rail unit 2 whether in the factory or on-site. Specifically, since the base plate 211 of the corresponding rail unit 2 is directly secured to the corresponding side wall 11 of the cabinet body 1, the present invention may keep the same assembly process as the prior art for securing the first slide rail 21 to the side wall 11 of the corresponding cabinet body 1. Additionally, because the present invention avoids the need to modify assembly procedures or dimensions of the drawer 3, a low fabrication cost maybe maintained.

Moreover, the guiding unit 4 is made by the process of plastic injection molding. By virtue of the apertures 417 each formed between two adjacent teeth 414, the guiding unit 4 may be easily ejected from a molding die and may avoid problems caused by uneven expansion and contraction during molding. Even if the guiding unit 4 is made of other material, apertures 217 are needed to allow tools to enter therethrough to form the barb surface 421 of the corresponding engaging hook 42.

Specifically, the smooth sliding mechanism of the sliding rail unit 2 is dependent on the quality of a rolling-forming machine because of its effect on the smooth movement of the first sets of balls 23. After the guide plates 212 are formed by the rolling-forming machine, a manufacturer of sliding units is not required to do further work on the guide plates 212 so as to avoid nicks or indentations from inappropriate destructive machining since during assembly, the balls of the first sets of balls 23 roll through the entire length of the guide plate 212. When the securing portions 216 are formed via a pressing process, they are formed with a width smaller than a diameter of each ball of the first sets of balls 23. During assembly, each of the first sets of balls 23 may rotatably pass through the first roller-free section 214 containing the securing portions 216. In addition, the securing portions 216 are formed on the one of the guide plates 212 that is disposed with the longitudinal guiding unit 4 by the pressing process so as to avoid deformation of the guide plate 212. Since the securing portions 216 and the inclined tab 217 of the first slide rail 21 are respectively formed in the first roller-free section 214 and the second roller-free section 215, the securing portions 216 and the inclined tab 217 will not affect the smoothness of the non-roller-free section 213 so that the first sets of balls 23 can smoothly move within the non-roller-free section 213.

By virtue of the general design that the rail unit 2 and the guiding unit 4 engage with each other, the guided slide assembly, the guiding unit, and the sliding rail unit called for in the appended claims comply with the requirement of unity of invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A guided slide assembly comprising:

at least one sliding rail unit having a first slide rail having a longitudinal base plate, a pair of guide plates extending respectively and transversely from two opposite sides of said base plate, and at least one securing portion formed on one of said guide plates, each of said guide plates contacting and covering a plurality of balls that roll thereon, said securing portion being a slit hook formed in said one of said guide plates by a pressing process; and at least one longitudinal guiding unit detachably disposed on said one of said guide plates, and having a longitudinal rack member and at least one engaging hook disposed on said rack member, said engaging hook engaging said securing portion on said one of said guide plates, said longitudinal rack member being formed with a longitudinal toothed portion and an aperture, said toothed portion having a plurality of longitudinally spaced-apart teeth, each of said teeth having a tip and a root, said aperture extending through a gap between said roots of two adjacent said teeth, said engaging hook projecting oppositely of said tip from one of said roots of said two adjacent said teeth, said engaging hook having a barb surface that is aligned with said aperture and that is spaced apart from said roots;

wherein said longitudinal rack member further includes two spaced-apart longitudinal retaining walls, a longitudinal recess and at least two side retaining elements, said toothed portion bridging said retaining walls, said longitudinal recess being confined by said retaining walls and a back side of said toothed portion opposite to tips of said teeth, said engaging hook extending into said longitudinal recess, said side retaining elements being respectively disposed on two opposite sides of said engaging hook.

2. The guided slide assembly as claimed in claim 1, wherein said toothed portion further has at least one abutting member, said abutting member being spaced apart from said engaging hook and facing an open end of said engaging hook.

3. The guided slide assembly as claimed in claim 1, further comprising a slotted part disposed at one end of said rack member.

4. A guided slide assembly comprising:

at least one sliding rail unit having a first slide rail having a longitudinal base plate, a pair of guide plates extending respectively and transversely from two opposite sides of said base plate, and at least one securing portion formed on one of said guide plates, each of said guide plates contacting and covering a plurality of balls that roll thereon, said securing portion being a slit hook formed in said one of said guide plates by a pressing process;

at least one longitudinal guiding unit detachably disposed on said one of said guide plates, and having a longitudinal rack member and at least one engaging hook disposed on said rack member, said engaging hook engaging said securing portion on said one of said guide plates, said longitudinal rack member being formed with a longitudinal toothed portion and an aperture, said toothed portion having a plurality of longitudinally spaced-apart teeth, each of said teeth having a tip and a root, said aperture extending through a gap between said roots of two adjacent said teeth, said engaging hook projecting oppositely of said tip from one of said roots of said two adjacent said teeth, said engaging hook having a barb surface that is aligned with said aperture and that is spaced apart from said roots; and at least two side retaining elements formed on said rack member, said side retaining elements respectively extending on two opposite sides of said engaging hook.

5. The guided slide assembly as claimed in claim 4, wherein said toothed portion further has at least one abutting member, said abutting member being spaced apart from said engaging hook and facing an open end of said engaging hook.

6. The guided slide assembly as claimed in claim 4, wherein said guiding unit further has a slotted part disposed at one end of said rack member.

* * * * *